US010804623B2

(12) United States Patent
Minamino

(10) Patent No.: US 10,804,623 B2
(45) Date of Patent: Oct. 13, 2020

(54) FEMALE CONNECTOR AND FITTING CONNECTOR

(71) Applicant: Yazaki Corporation, Tokyo (JP)

(72) Inventor: Yuya Minamino, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 16/400,005

(22) Filed: Apr. 30, 2019

(65) Prior Publication Data

US 2019/0348774 A1 Nov. 14, 2019

(30) Foreign Application Priority Data

May 14, 2018 (JP) ..... 2018-092789

(51) Int. Cl.
*H01R 4/48* (2006.01)

(52) U.S. Cl.
CPC ..... *H01R 4/4881* (2013.01)

(58) Field of Classification Search
CPC ..... H01R 4/4881; H01R 13/04; H01R 13/44; H01R 13/5219
USPC ..... 439/599, 634, 693, 695, 817
See application file for complete search history.

(56) References Cited

U.S. PATENT DOCUMENTS 4,152,041 A * 5/1979 Hollyday ..... H01R 13/7032 439/188
5,932,841 A * 8/1999 Matsumoto ..... H01R 13/6593 174/359
2006/0025021 A1* 2/2006 Ishizaki ..... H01R 24/542 439/677
2012/0329304 A1* 12/2012 Lopes ..... H01R 31/06 439/345
2016/0126657 A1* 5/2016 Hirakawa ..... H01R 13/42 439/733.1
2017/0244196 A1 8/2017 Lie
2017/0338604 A1* 11/2017 Yasuda ..... H01R 13/05
2019/0229461 A1* 7/2019 Lu ..... H01R 13/114
2019/0348790 A1* 11/2019 Mori ..... H01R 13/04
2019/0348802 A1* 11/2019 Yamanashi ..... H01R 24/38

FOREIGN PATENT DOCUMENTS

| | | | |
|---|---|---|---|
| EP | 3 208 892 | A1 | 8/2017 |
| JP | 7-296879 | A | 11/1995 |
| JP | 8-78079 | A | 3/1996 |
| WO | 96/29761 | A1 | 9/1996 |
| WO | 2017/223416 | A1 | 12/2017 |

* cited by examiner

*Primary Examiner* — Oscar C Jimenez

(74) *Attorney, Agent, or Firm* — Kenealy Vaidya LLP

(57) ABSTRACT

A female connector includes a female terminal and a female-side insulator. The female terminal is connected to a male terminal of a male connector including the male terminal having a tubular male-side connecting body and including a male-side insulator covering an end surface of the male-side connecting body. The female terminal has a tubular female-side connecting body defining a female-side space in which the male-side connecting body is inserted and fitted, and has a tubular accommodating portion defining an accommodation space for accommodating and retaining the female-side insulator.

3 Claims, 11 Drawing Sheets

FEMALE CONNECTOR AND FITTING CONNECTOR

CROSS-REFERENCE TO RELATED APPLICATION(S)

The present application claims priority to and incorporates by reference the entire contents of Japanese Patent Application No. 2018-092789 filed in Japan on May 14, 2018.

BACKGROUND OF THE INVENTION

1. Field of the Invention

The present invention relates to a female connector and a fitting connector.

2. Description of the Related Art

Fitting connectors including a female connector having a female terminal and a male connector having a male terminal have been known. Fitting the male connector in the female connector connects the male terminal with the female terminal physically and electrically. The female connector of such a fitting connector includes a tubular female terminal and a female-side insulator disposed inside the female terminal. The female-side insulator is provided to prevent fingers from touching the female terminal, and has, for example, a columnar shape. The male connector of the fitting connector includes a male terminal configured to be inserted and fitted in the female terminal, and a male-side insulator that covers an end surface of the male terminal. The male-side insulator is provided to prevent fingers from touching the end of the male terminal. The male terminal and the male-side insulator define a space in which the female-side insulator is inserted when the female connector and the male connector are fitted. The female connector and the fitting connector of this kind are disclosed in, for example, Japanese Patent Application Laid-open No. H08-078079.

To carry out the function of preventing fingers from touching the female terminal, the female terminal and the female-side insulator of the female connector are configured not to be displaced relative to each other from an expected full accommodation position.

SUMMARY OF THE INVENTION

In view of the foregoing, it is an object of the present invention to provide a female connector and a fitting connector that enable a female terminal and a female-side insulator to be assembled and positioned relative to each other as expected.

A female connector according to one aspect of the present invention includes a female terminal configured to be physically and electrically connected to a male terminal of a male connector including the male terminal and an insulating male-side insulator, the male terminal having a tubular male-side connecting body, the male-side insulator having a tubular outer tube covering coaxially an end surface of the male-side connecting body at a side of a connector insertion direction; and an insulating female-side insulator, wherein the female terminal has a tubular female-side connecting body defining a female-side space in which the male-side connecting body is coaxially inserted and fitted, and has a tubular accommodating portion defining an accommodation space in which the female-side insulator is accommodated and retained, the female-side connecting body and the accommodating portion being coaxially aligned, the female-side insulator has a columnar or tubular finger-touching preventing portion and a columnar or tubular accommodated portion, the finger-touching preventing portion being coaxially disposed in the female-side space, and disposed in a space defined by the outer tube and in a male-side space defined by the male-side connecting body when the female-side connecting body and the male-side connecting body are in an inserted and fitted state, the accommodated portion being coaxially accommodated in the accommodation space, and a securing structure that secures the accommodating portion and the accommodated portion relative to each other at a full accommodation position is provided between the accommodating portion and the accommodated portion.

According to another aspect of the present invention, in the female connector, it is preferable that the securing structure includes a first securing portion provided in the accommodating portion and a second securing portion provided in the accommodated portion, the first securing portion and the second securing portion being engaged with each other to secure the accommodating portion and the accommodated portion relative to each other at the full accommodation position.

According to still another aspect of the present invention, in the female connector, it is preferable that one of the first securing portion and the second securing portion is formed as a securing protrusion that protrudes in a direction orthogonal to an axial direction of the accommodating portion and the accommodated portion, and the other one of the first securing portion and the second securing portion is formed as a locking part having a through-hole or an indentation shape, the locking part in which the securing protrusion is inserted and locked in the axial direction and a circumferential direction of the accommodating portion and the accommodated portion.

According to still another aspect of the present invention, in the female connector, it is preferable that the securing structure includes a securing through-hole provided in the accommodating portion, a securing space provided in the accommodated portion and facing the securing through-hole at the full accommodation position, and a securing member inserted and fitted in the securing through-hole and in the securing space.

According to still another aspect of the present invention, in the female connector, it is preferable that the accommodating portion has an opening away from the female-side connecting body, the opening being used as an insertion opening for the female-side insulator, and the female connector further includes a guiding structure between the accommodating portion and the accommodated portion to guide the accommodated portion that is axially inserted from the insertion opening to the full accommodation position is provided.

A fitting connector according to still another aspect of the present invention includes a female connector including a female terminal and an insulating female-side insulator; and a male connector including a male terminal and an insulating male-side insulator, wherein the female terminal has a tubular female-side connecting body defining a female-side space, and has a tubular accommodating portion defining an accommodation space in which the female-side insulator is accommodated and retained, the female-side connecting body and the accommodating portion being coaxially aligned, the male terminal has a tubular male-side connecting body configured to be coaxially inserted and fitted in the female-side space, the male-side insulator has a tubular outer tube covering coaxially an end surface of the male-side connecting body at a side of a connector insertion direction, the female-side insulator has a columnar or tubular finger-touching preventing portion and a columnar or tubular accommodated portion, the finger-touching preventing portion being coaxially disposed in the female-side space, and disposed in a space defined by the outer tube and in a male-side space defined by the male-side connecting body when the female-side connecting body and the male-side connecting body are in an inserted and fitted state, the accommodated portion being coaxially accommodated in the accommodation space, and a securing structure that secures the accommodating portion and the accommodated portion relative to each other at a full accommodation position is provided between the accommodating portion and the accommodated portion.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 1:
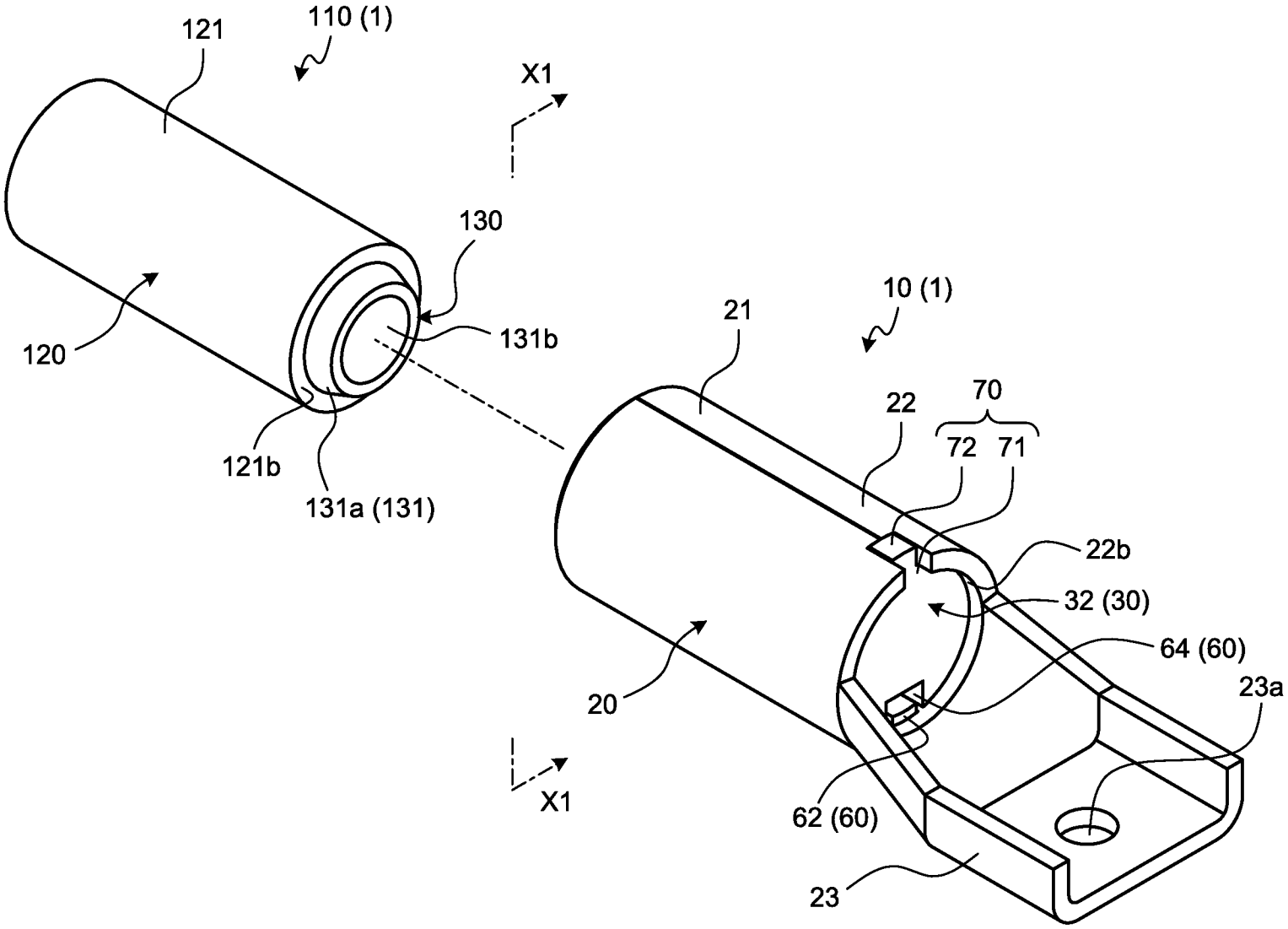
FIG. 1 is a perspective view of a fitting connector according to an embodiment of the present invention in a disengaged state.

The following describes an embodiment of a fitting connector according to the present invention with reference to the accompanying drawings. The embodiment is not intended to limit the scope of the present invention.

Embodiment

One embodiment of the fitting connector according to the present invention will be described with reference to FIGS. 1 to 11.

Reference sign 1 in FIGS. 1 to 4 indicates the fitting connector according to the present embodiment. This fitting connector 1 is what is called a male/female connector, and includes a female connector 10 (FIGS. 1 to 6) including a female terminal 20 and an insulating female-side insulator 30, and a male connector 110 (FIGS. 1 to 4 and 7) including a male terminal 120 and an insulating male-side insulator 130. For ease of discussion, these drawings do not illustrate a female housing 40 and a male housing 140 to be described later.

Figure 2:
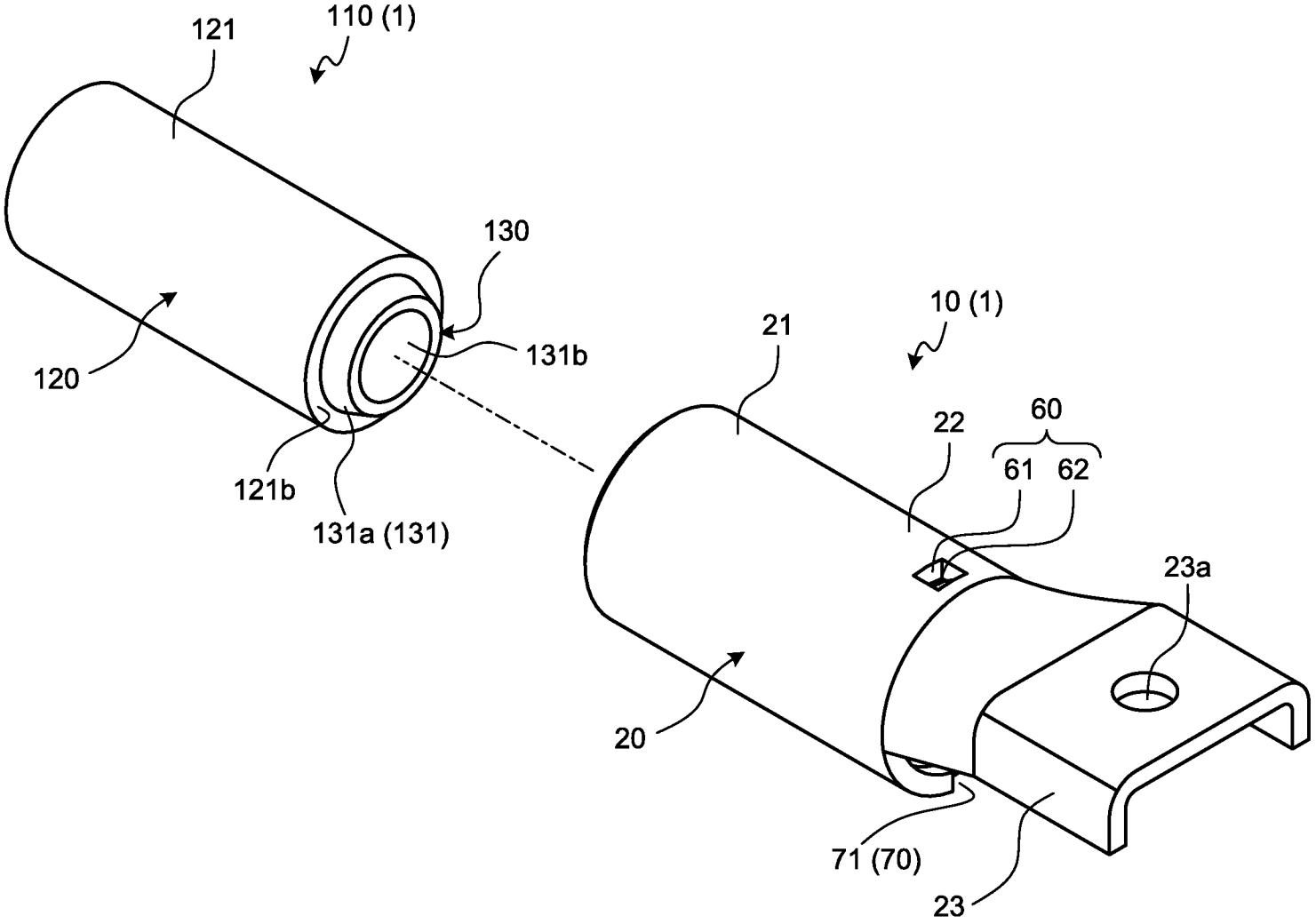
FIG. 2 is a perspective view of the fitting connector according to the embodiment in a disengaged state seen from another angle.
Figure 3:
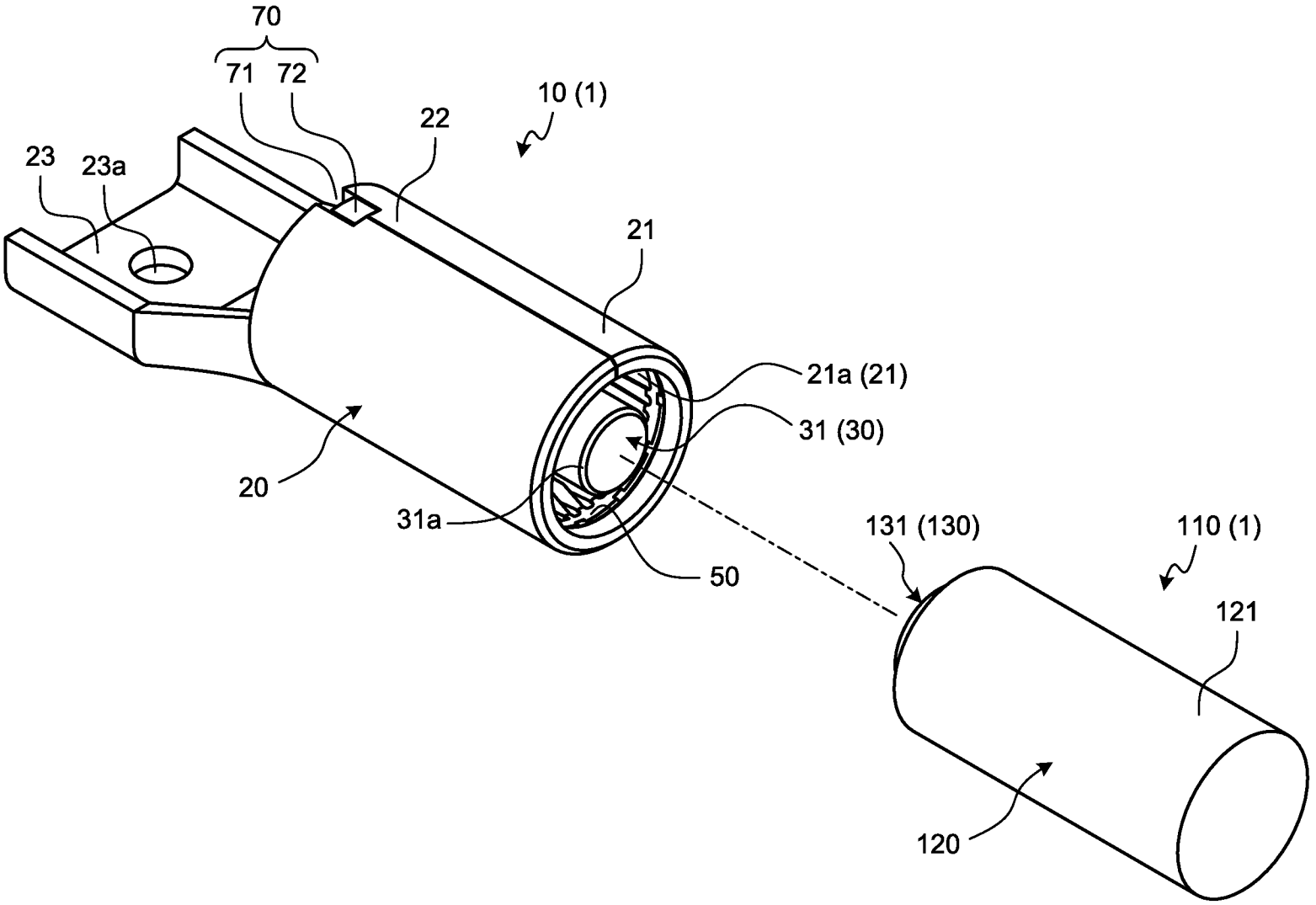
FIG. 3 is a perspective view of the fitting connector according to the embodiment in a disengaged state seen from still another angle.
Figure 4:
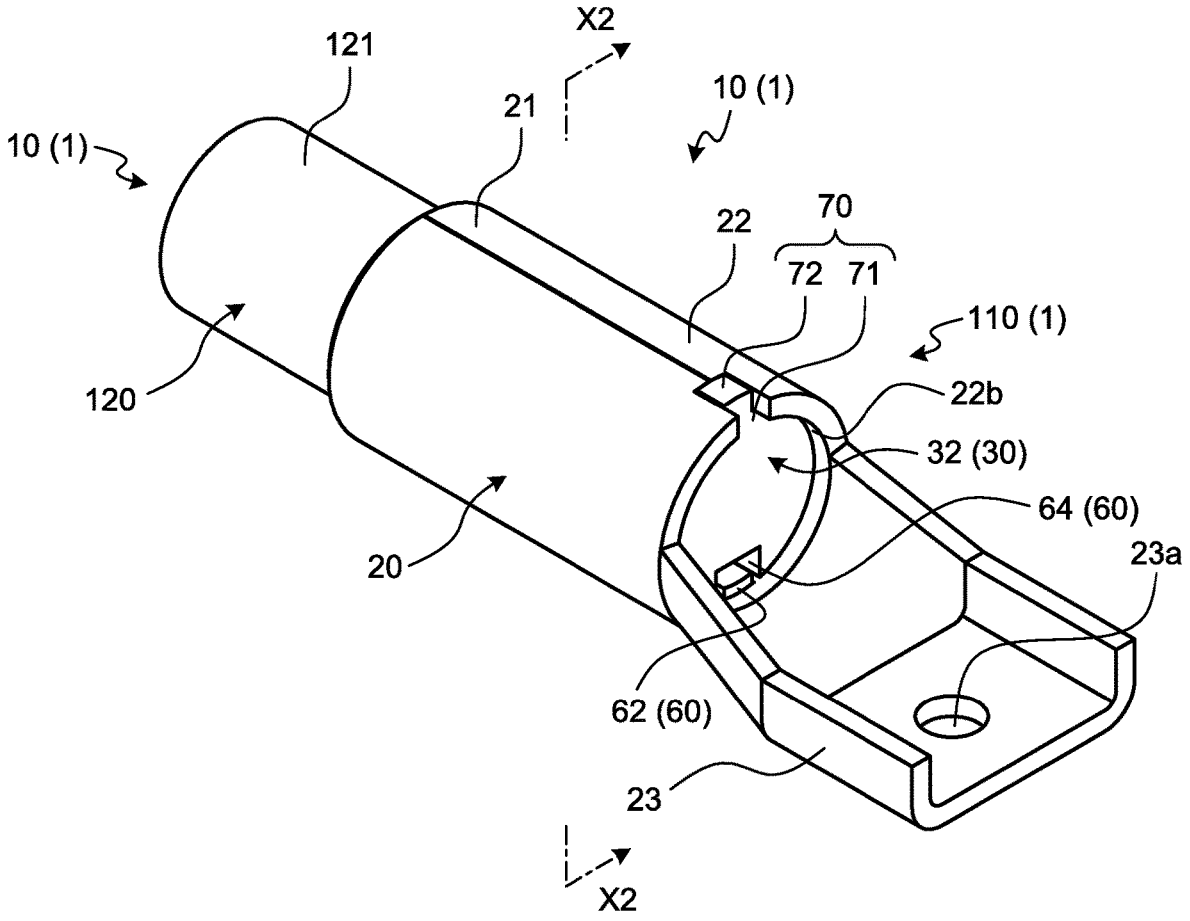
FIG. 4 is a perspective view of the fitting connector according to the embodiment in an inserted and fitted state.

The female connector 10 and the male connector 110 of the fitting connector 1 are fitted with each other after insertion operation, and accordingly, the male terminal 120 is inserted and fitted in the female terminal 20, and the female terminal 20 and the male terminal 120 are physically and electrically connected (FIG. 4). The female connector 10 and the male connector 110 of the fitting connector 1 are disengaged by being separated from each other, whereby the female terminal 20 and the male terminal 120 are physically and electrically disconnected (FIGS. 1 to 3). The direction in which a connector is inserted and fitted in the other connector is opposite to the direction in which the connector is disengaged from the other connector. In the following description, the insertion and fitting direction is referred to as a "connector insertion direction" and the disengaging direction is referred to as a "connector disengaging direction". These directions are used to indicate a direction in which a subject connector is inserted in or separated from the other counterpart connector.

First, the female connector 10 will be described.

The female connector 10 includes, in addition to the female terminal 20 and the female-side insulator 30, the female housing 40 (FIGS. 8 and 9) that houses the female terminal 20 and the female-side insulator 30.

Figure 8:
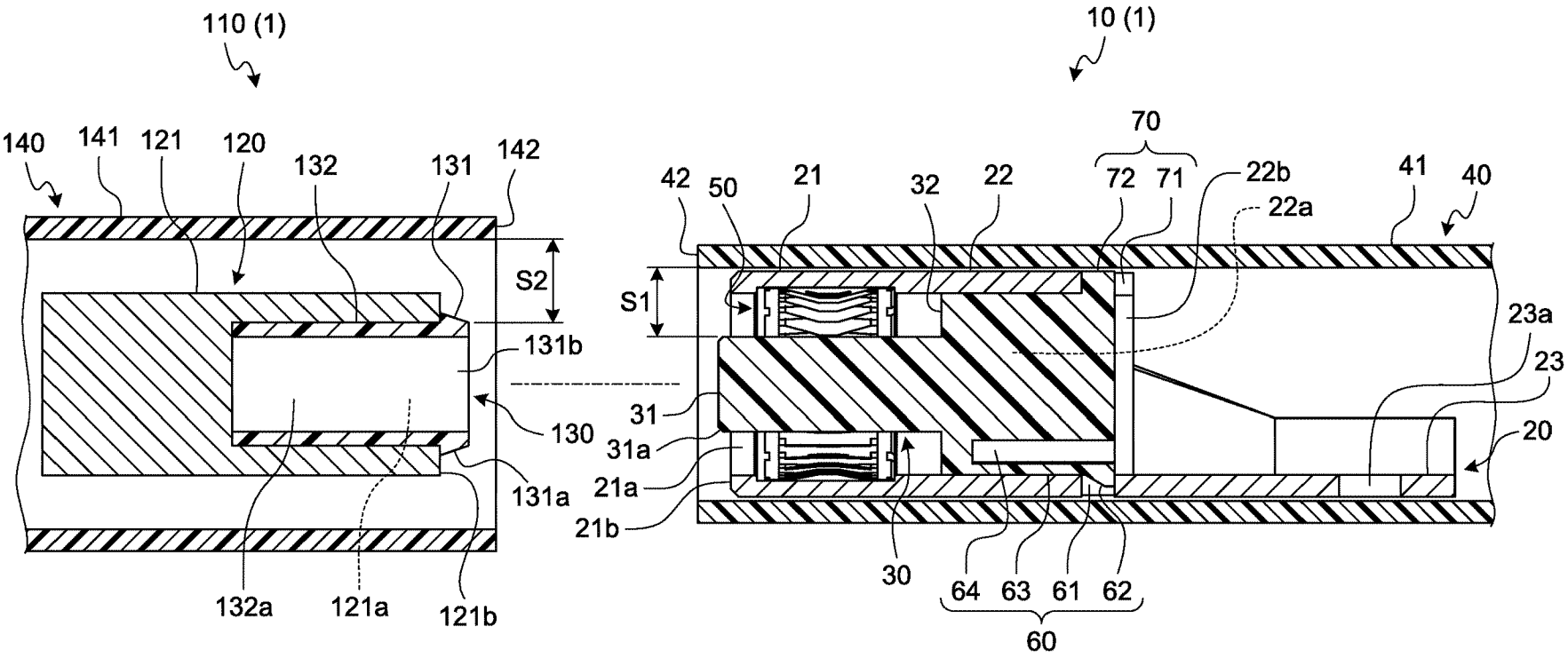
FIG. 8 is a cross-sectional view taken along line X1-X1 in FIG. 1.
Figure 9:
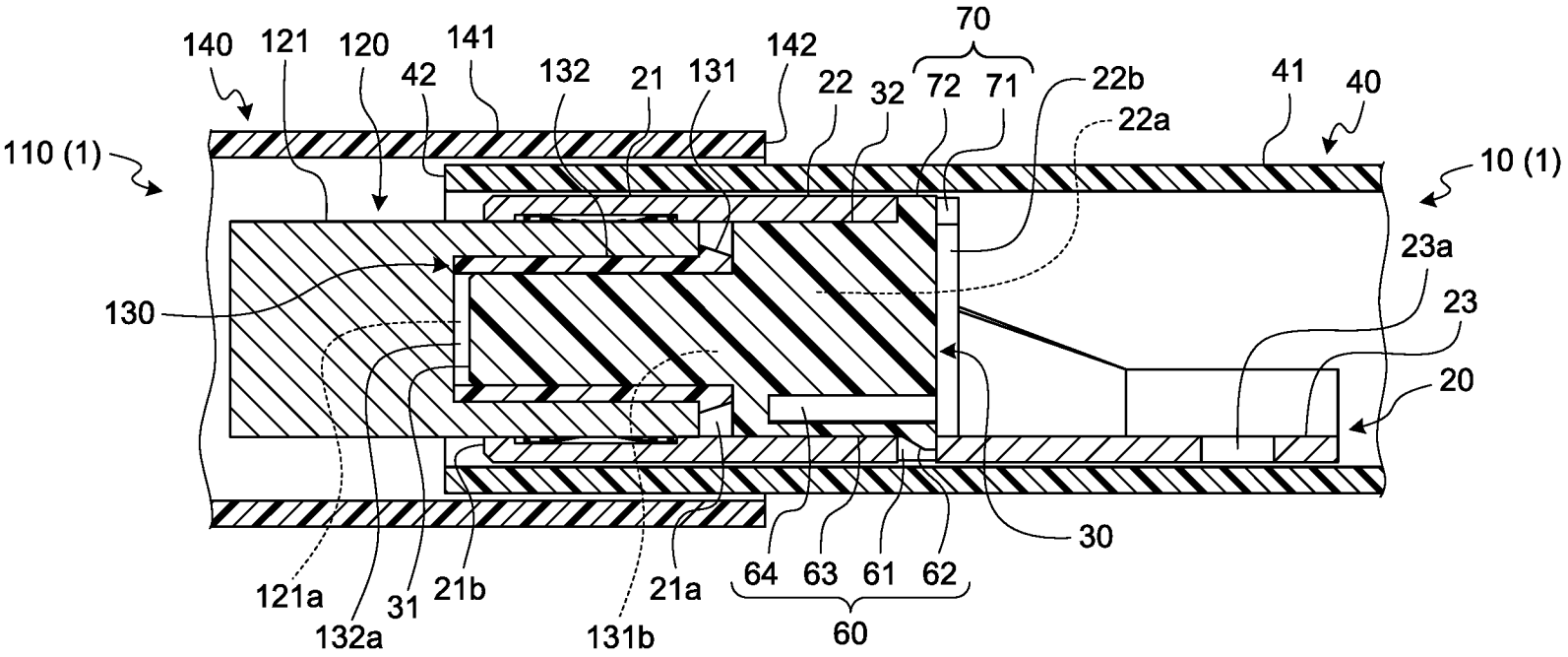
FIG. 9 is a cross-sectional view taken along line X2-X2 in FIG. 4.

The female terminal 20 is made of a conductive material such as metal. The female terminal 20 has a tubular female-side connecting body 21 defining a female-side space 21*a* (FIGS. 3, 8, and 9). The female terminal 20 also has a tubular accommodating portion 22 (FIGS. 5, 8, and 9) defining an accommodation space 22*a* in which the female-side insulator 30 is accommodated and retained. The female-side connecting body 21 and the accommodating portion 22 of the female terminal 20 are aligned coaxially. In the present example, the female-side connecting body 21 and the accommodating portion 22 are coaxially aligned next to each other. The female-side connecting body 21 and the accommodating portion 22 in the present example have a cylindrical shape. The female terminal 20 further includes a fastening member 23 (FIGS. 1 to 6, 8, and 9) projecting from the accommodating portion 22 in a direction away from the female-side connecting body 21. The fastening member 23 is a member for use in fastening the female terminal 20 to a conductive member (not illustrated) to which current flows. The fastening member 23 has a through-hole 23*a*. The fastening member 23 is fastened by screwing to the conductive member with a male screw (not illustrated) inserted in the through-hole 23*a*.

In the female-side space 21*a* in the female-side connecting body 21, a male-side connecting body 121, which will be described later, of the male terminal 120 is coaxially inserted and fitted. The female terminal 20 and the male terminal 120 are physically and electrically connected via the female-side connecting body 21 and the male-side connecting body 121 in an inserted and fitted state.

Figure 5:
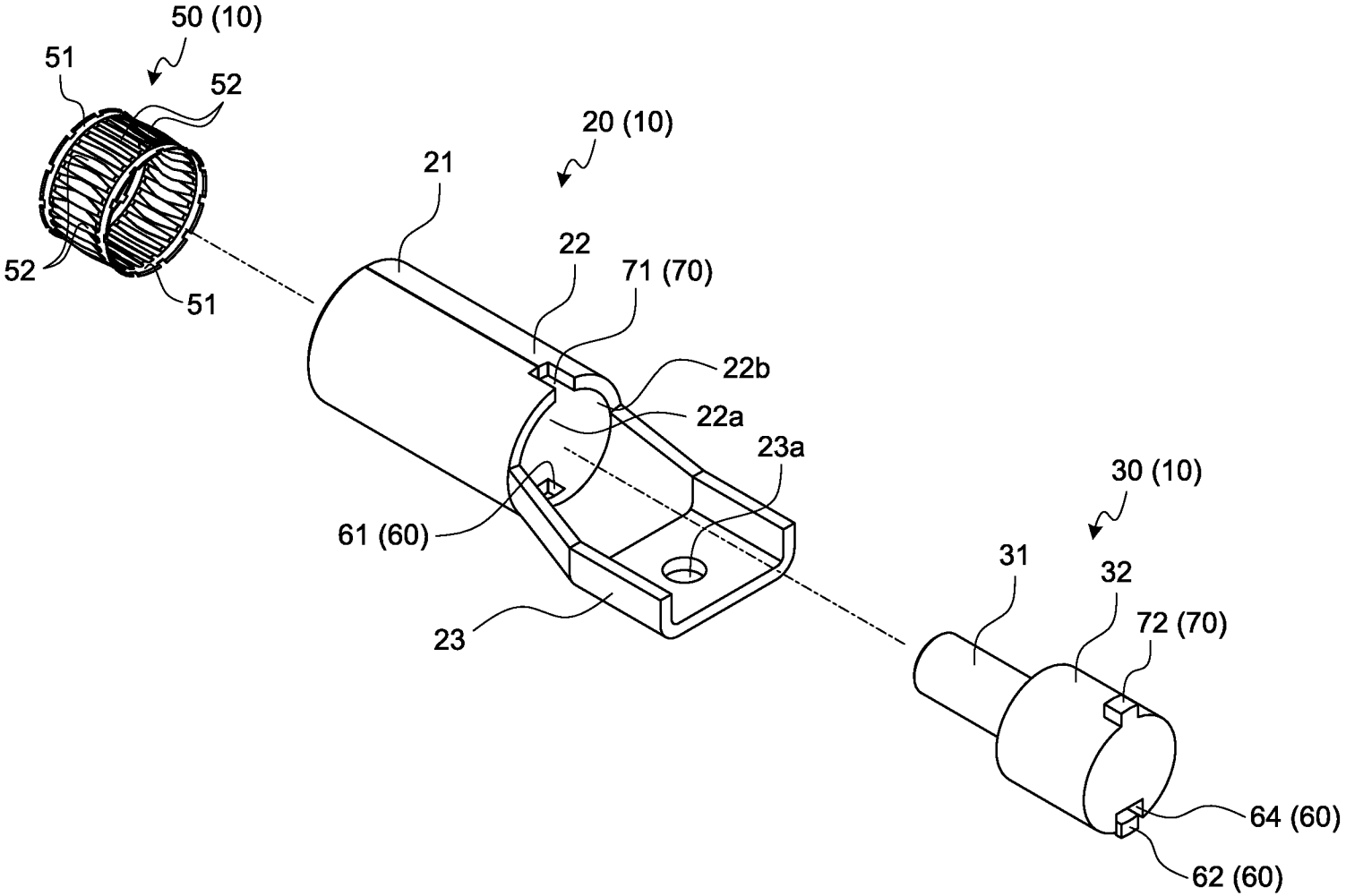
FIG. 5 is an exploded perspective view of a female connector.
Figure 6:
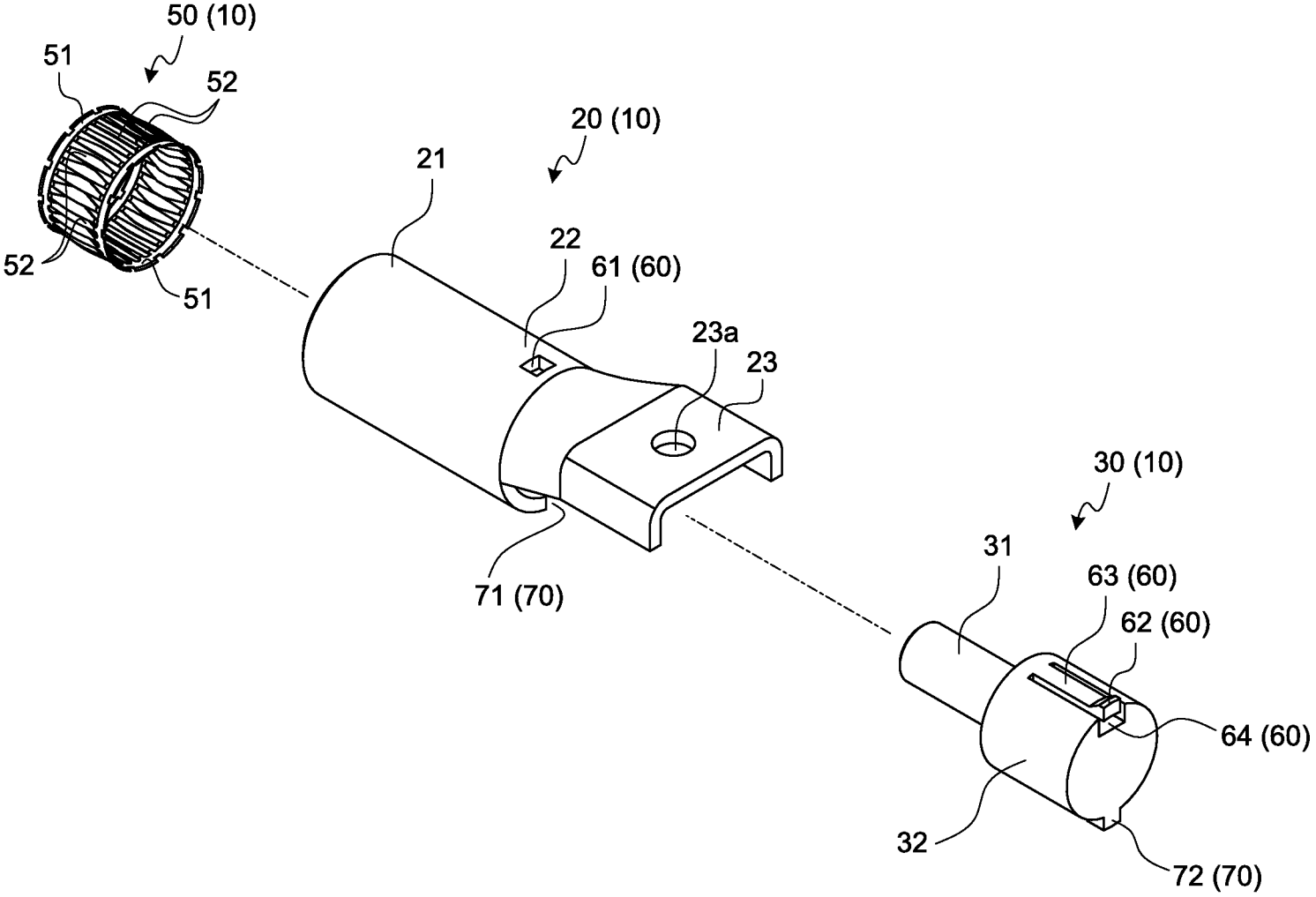
FIG. 6 is an exploded perspective view of the female connector seen from another angle.
Figure 7:
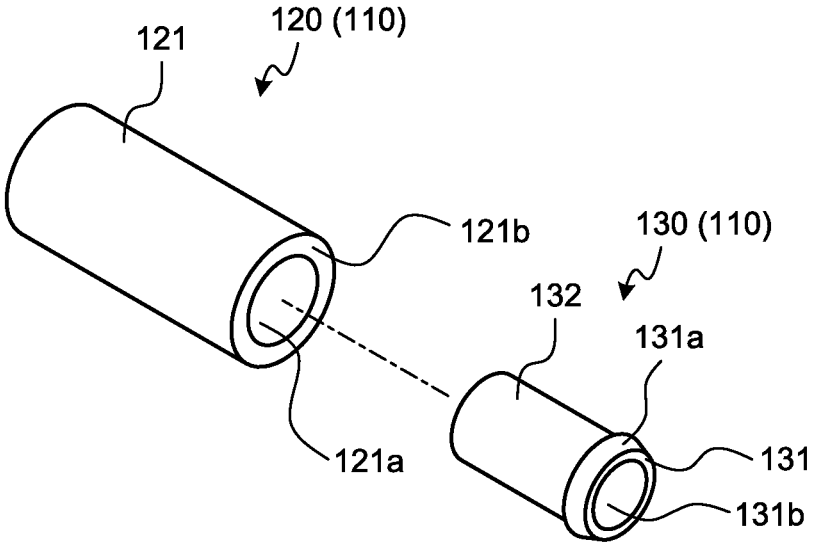
FIG. 7 is an exploded perspective view of a male connector.

In the present example, a contact member 50 (FIGS. 3, 5, and 6) is interposed between the female-side connecting body 21 and the male-side connecting body 121, and the female-side connecting body 21 and the male-side connecting body 121 are physically and electrically connected via the contact member 50. The contact member 50 includes two ring portions 51 that are coaxially spaced apart and a plurality of contact portions 52 each connecting the two ring portions 51 (FIGS. 5 and 6). The contact member 50 is physically and electrically connected to the female-side connecting body 21 with the two ring portions 51 being in contact with and retained by the inner circumferential surface of the female-side connecting body 21 defining the female-side space 21*a*. The ring portions 51 in the present example have an annular shape. The contact portions 52 are disposed around the axis. The contact portions 52 have elasticity like springs. When the male-side connecting body 121 is inserted, and presses the contact portions 52, the contact portions 52 exert an opposing elastic force. With the elasticity of the contact portions 52, the contact member 50 is physically and electrically connected to the male-side connecting body 121.

The female-side insulator 30 is made of an insulating material such as synthetic resin. The female-side insulator 30, together with the female housing 40, prevents fingers from touching the female terminal 20. The female-side insulator 30 is accommodated in the female-side space 21*a* and the accommodation space 22*a* inside the female terminal 20. The female-side insulator 30 has a columnar or tubular finger-touching preventing portion 31 (FIGS. 3, 5, 6, 8, and 9) disposed coaxially in the female-side space 21*a*. The female-side insulator 30 has a columnar or tubular accommodated portion 32 (FIGS. 1, 4 to 6, 8, and 9) accommodated coaxially in the accommodation space 22*a*. In the present example, the finger-touching preventing portion 31 and the accommodated portion 32 have a columnar shape.

The finger-touching preventing portion 31 has an outer diameter smaller than the diameter of the female-side space 21*a*. This configuration creates a tubular space between the finger-touching preventing portion 31 and the inner circumferential surface of the female-side connecting body 21 defining the female-side space 21*a*. The male-side connecting body 121 is inserted in this tubular space. The finger-touching preventing portion 31 is disposed in a male-side space 121*a*, which will be described later, in the male-side connecting body 121 when the female-side connecting body 21 and the male-side connecting body 121 are in an inserted and fitted state.

Specifically, the finger-touching preventing portion 31 in the present example is disposed in a first space 131*b* defined by an outer tube 131, which will be described later, and in the male-side space 121*a* when the female-side connecting body 21 and the male-side connecting body 121 are in an inserted and fitted state. First, an end of the finger-touching preventing portion 31 at a side of the connector insertion direction enters in the first space 131*b* and then reaches the male-side space 121*a*. In a preferred embodiment, the finger-touching preventing portion 31 has a ring-shaped chamfered portion 31*a* (FIGS. 3 and 8) circumferentially disposed at an end at the side of the connector insertion direction to facilitate insertion of the finger-touching preventing portion 31 in the first space 131*b*. The chamfered portion 31*a* may be a curved surface or a flat surface. The chamfered portion 31*a* in the present example has a tapered shape.

The female-side insulator 30 is formed separately from the female terminal 20, and is assembled with the female terminal 20 such that the finger-touching preventing portion 31 is inserted in the female-side space 21*a* in the female-side connecting body 21 and the accommodated portion 32 is inserted in the accommodation space 22*a* in the accommodating portion 22. To assemble the female-side insulator 30 with the female terminal 20, for example, the accommodated portion 32 is fitted in the accommodation space 22*a*.

In assembling the separately formed female terminal 20 and female-side insulator 30 of the female connector 10, the female-side insulator 30 is inserted in the female terminal 20 from a side close to the accommodating portion 22. The accommodating portion 22 has an opening away from the female-side connecting body 21 for use as an insertion opening 22*b* (FIGS. 1, 4, 5, 8, and 9) for the female-side insulator 30. In inserting the female-side insulator 30, the finger-touching preventing portion 31 is first inserted in the insertion opening 22*b*.

The female terminal 20 and the female-side insulator 30 of the female connector 10 are assembled such that the female-side insulator 30 is inserted in the female terminal 20 and positioned relative to the female terminal 20 at an expected full accommodation position. The expected full accommodation position is a position of the female-side insulator 30 relative to the female terminal 20 at which the female-side insulator 30 can carry out the function (at least a finger-touching preventing function) required for the female-side insulator 30. To assemble the female-side insulator 30 at such a position, the female connector 10 includes a securing structure 60 (FIGS. 1, 2, 4 to 6, 8, and 9) between the accommodating portion 22 and the accommodated portion 32 to secure them at the full accommodation position.

The securing structure 60 includes, for example, a first securing portion 61 included in the accommodating portion 22 and a second securing portion 62 included in the accommodated portion 32 (FIGS. 2, 5, 6, 8, and 9). The securing structure 60 secures the accommodating portion 22 and the accommodated portion 32 at the full accommodation position with the first securing portion 61 and the second securing portion 62 being engaged with each other. For example, one of the first securing portion 61 and the second securing portion 62 is formed as a securing protrusion that protrudes in a direction perpendicular to the axis of the accommodating portion 22 and the accommodated portion 32. The other one of the first securing portion 61 and the second securing portion 62 is formed as a locking part having a through-hole or indentation shape in which the securing protrusion is inserted to lock the securing protrusion in the axial direction and the circumferential direction of the accommodating portion 22 and the accommodated portion 32. In the present example, the first securing portion 61 is formed as the locking part and the second securing portion 62 is formed as the securing protrusion.

The second securing portion 62 in the present example is provided at a free end of a flexible tip 63 having flexibility (FIGS. 6, 8, and 9). The flexible tip 63 has a fixed end and the free end that are disposed in the axial direction of the accommodated portion 32. The accommodated portion 32 has a retraction space 64 (FIGS. 1, 4 to 6, 8, and 9) into which the second securing portion 62 is retracted when the flexible tip 63 bends radially inward. When the second securing portion 62 is pushed by the inner circumferential surface of the accommodating portion 22 defining the accommodation space 22*a*, the flexible tip 63 bends, and accordingly, the second securing portion 62 is retracted into the retraction space 64. At the full accommodation position, the flexible tip 63 is released from the bent state and the second securing portion 62 is inserted in the first securing portion 61.

To assemble the female connector 10, the female-side insulator 30 is inserted from the insertion opening 22*b* of the accommodating portion 22 such that the first securing portion 61 is engaged with the second securing portion 62 at the full accommodation position. In the securing structure 60 in the present example, the second securing portion 62 as the securing protrusion is inserted in the first securing portion 61 as the locking part having a through-hole or an indentation shape when the female-side insulator 30 reaches the full accommodation position.

With the securing function of the securing structure 60 in the female connector 10, the separately formed female terminal 20 and female-side insulator 30 can be assembled and positioned relative to each other at the expected full accommodation position. This configuration allows the female connector 10 according to the present embodiment to carry out the finger-touching preventing function from the female terminal 20. In addition, since the female-side insulator 30 can be assembled with the female terminal 20 at the full accommodation position, the female connector 10 can carry out a centering function to be described later. Since this securing structure 60 can keep the positional relation between the female terminal 20 and the female-side insulator 30, the female connector 10 can keep the finger-touching preventing function from the female terminal 20 and the centering function even after the connectors are fitted (the male connector 110 is connected to the female connector 10) or after the connectors are disengaged (the male connector 110 is removed from the female connector 10).

Since the separately formed female terminal 20 and female-side insulator 30 can be assembled and positioned relative to each other at an expected full accommodation position, this can facilitate the assembling process of the female connector 10. This configuration can avoid, for example, mistakenly finishing the assembly of the female terminal 20 and the female-side insulator 30 before the female-side insulator 30 reaches the full accommodation position in assembling the female connector 10. This configuration can also prevent over-insertion of the female-side insulator 30 beyond the full accommodation position in the female connector 10.

Figure 10:
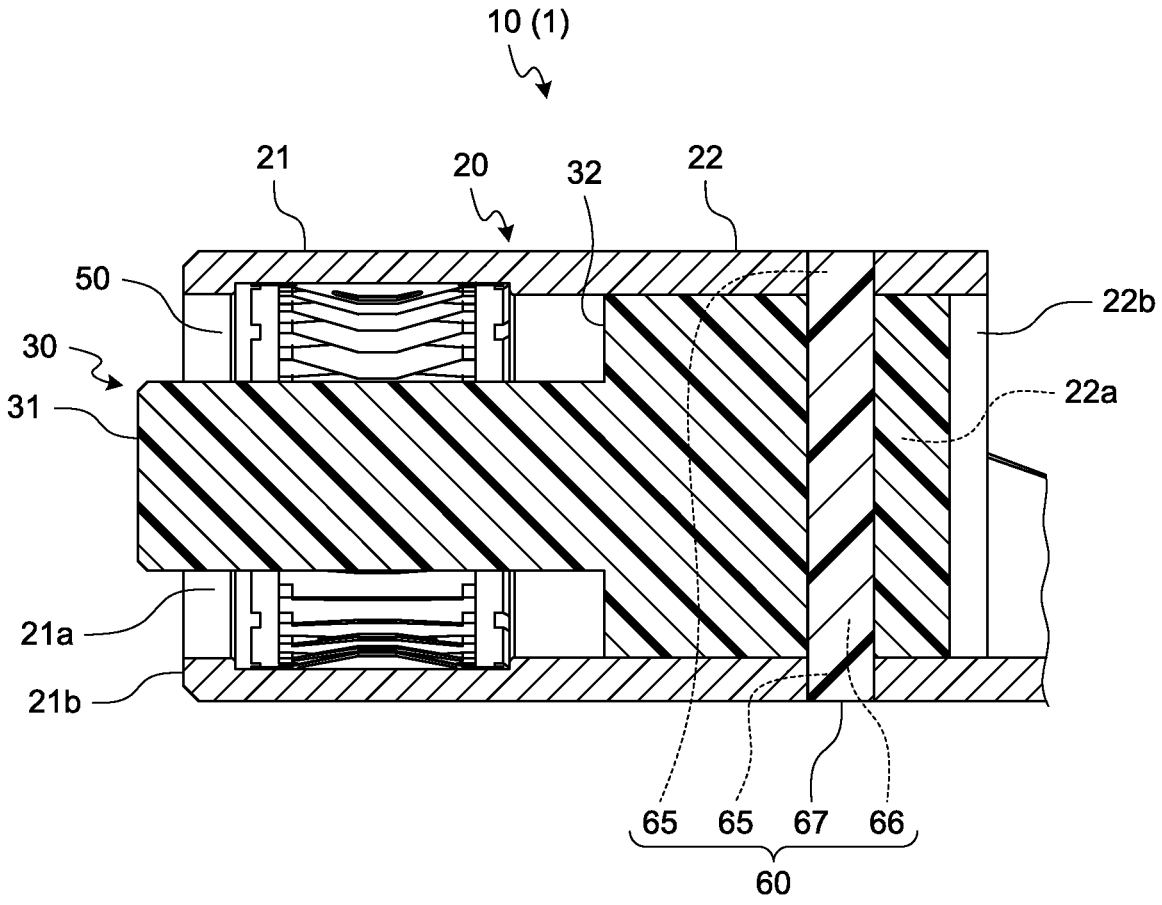
FIG. 10 is a cross-sectional view illustrating a modification of a retaining structure according to the embodiment.

Instead of the first securing portion 61 and the second securing portion 62, the securing structure 60 may be configured by the following structures. This securing structure 60 is configured by a securing through-hole 65 provided in the accommodating portion 22, a securing space 66 provided in the accommodated portion 32 and facing the securing through-hole 65 at the full accommodation position, and a securing member 67 inserted and fitted in the securing through-hole 65 and the securing space 66 (FIG. 10). For example, the accommodating portion 22 has two circular securing through-holes 65 radially disposed and facing each other across the accommodation space 22*a*. The accommodated portion 32 is formed with a columnar through-hole as the securing space 66 with its two openings facing the respective securing through-holes 65. The securing member 67 is a columnar pin-like member made of an insulating material such as synthetic resin, and one end of the securing member 67 is inserted in one of the two securing through-holes 65 and is placed in the 66 until the end reaches the other securing through-hole 65. The securing member 67 is fitted in the two securing through-holes 65 and the securing space 66. If the female connector 10 includes this type of securing structure 60, it can have the same effect as the previous example above. Although the securing member 67 is made of an insulating material such as synthetic resin, the securing member 67 may be a columnar pin-like member made of a conductive material such as metal.

In a preferred embodiment, the female connector 10 includes a guide structure 70 (FIGS. 1 to 6, 8, and 9) between the accommodating portion 22 and the accommodated portion 32 to guide the accommodated portion 32 inserted from the insertion opening 22*b* of the accommodating portion 22 in the axial direction to the full accommodation position. The guide structure 70 includes a first guide portion 71 provided in the accommodating portion 22 and a second guide portion 72 provided in the accommodated portion 32 (FIGS. 1, 3 to 6, 8, and 9). For example, one of the first guide portion 71 and the second guide portion 72 is formed as a guiding protrusion that protrudes in a direction perpendicular to the axis of the accommodating portion 22 and the accommodated portion 32. The other one of the first guide portion 71 and the second guide portion 72 is formed as a guiding groove for guiding the guiding protrusion to the full accommodation position when the accommodated portion 32 is inserted from the insertion opening 22*b* in the axial direction. In the present example, the first guide portion 71 is formed as the guiding groove and the second guide portion 72 is formed as the guiding protrusion. In the present example, a rectangular plate is bent to create a cylindrical shape, thereby forming the female-side connecting body 21 and the accommodating portion 22. First, two edge portions of the rectangular plate in an area corresponding to the accommodating portion 22 after bending are cut out, and then the plate is bent to have the two rectangular cut-out portions meet in the circumferential direction. The first guide portion 71 in the present example is configured by the two rectangular cut-out portions disposed next to each other.

The female-side insulator 30 in the female connector 10 is inserted from the insertion opening 22*b* of the accommodating portion 22 such that the first guide portion 71 is engaged with the second guide portion 72, that is, the second guide portion 72 formed as the guiding protrusion is inserted in the first guide portion 71 formed as the guiding groove. If the securing structure 60 is of any type, this configuration facilitates assembling and positioning of the separately formed female terminal 20 and female-side insulator 30 of the female connector 10 relative to each other at an expected full accommodation position. The female connector 10 having such configuration can be assembled with much easier assembling process of the female terminal 20 and the female-side insulator 30.

The female connector 10 has an insulating ring portion 42 (FIGS. 8 and 9) disposed outside of the female-side space 21*a* in a direction perpendicular to the axial direction of the female-side connecting body 21, and coaxially protruding beyond an end surface 21*b* of the female-side connecting body 21 at the side of the connector insertion direction. If the inner diameter of the ring portion 42 of the female connector 10 is smaller than the size of a reference finger, the finger-touching preventing function from the female terminal 20 may be carried out by the ring portion 42. The reference finger is, for example, the test finger specified in IPXXB degrees of protection. However, the female connector 10 according to the present embodiment assigns the function of preventing fingers from touching the female terminal 20 to both finger-touching preventing portion 31 and ring portion 42 in a case where the female connector 10 has a larger diameter and thus the ring portion 42 cannot prevent the finger from touching the female terminal 20.

Figure 11:
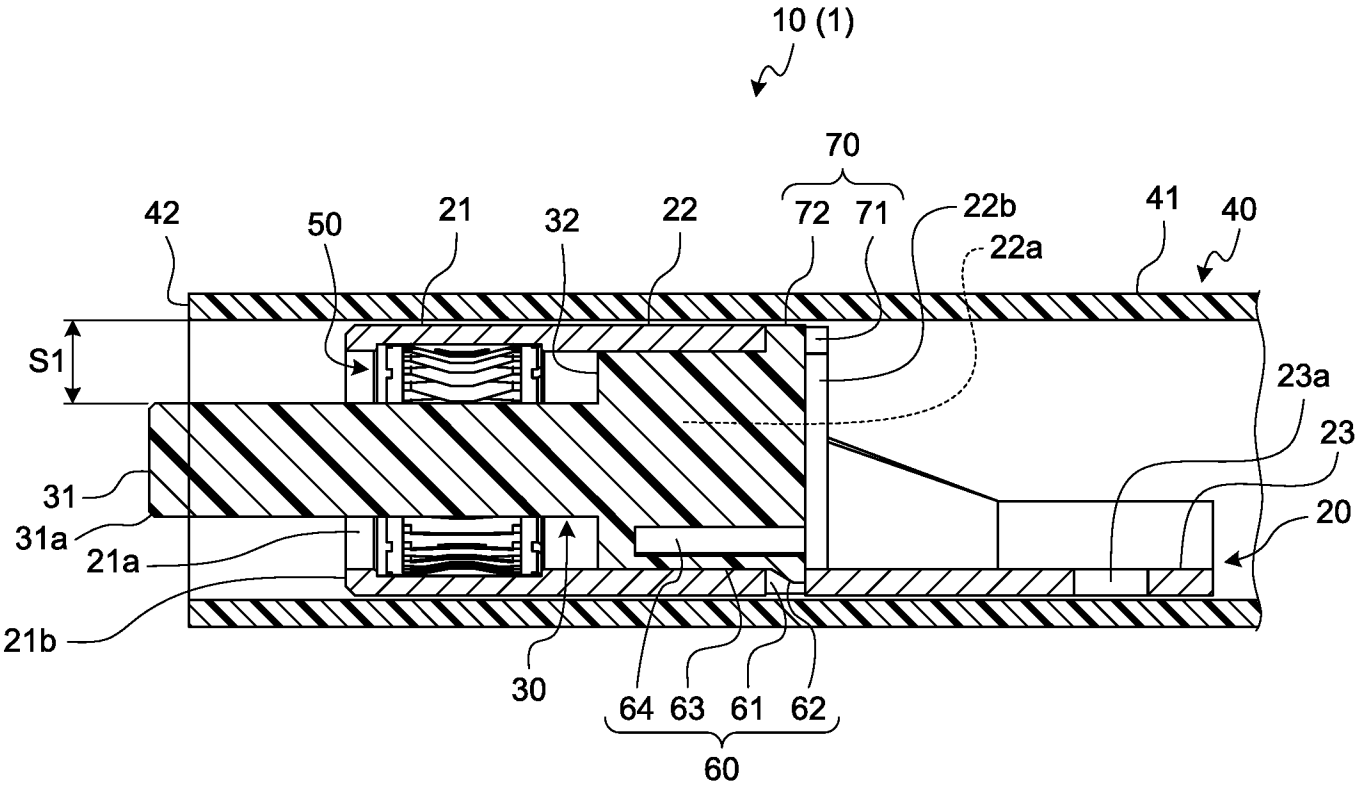
FIG. 11 is a cross-sectional view of a modification of the female connector according to the embodiment.

In this regard, the finger-touching preventing portion 31 protrudes in the axial direction beyond the end surface 21*b* of the female-side connecting body 21 at the side of the connector insertion direction (FIGS. 8 and 9). Specifically, an end of the finger-touching preventing portion 31 at the side of the connector insertion direction protrudes beyond the end surface 21*b*. With the finger-touching preventing portion 31 and the ring portion 42 that can prevent fingers from reaching the female terminal 20, the female connector 10 can prevent fingers from touching the female terminal 20 if the female connector 10 has, for example, a larger diameter to correspond to a larger-current device configuration. In this case, a gap S1 (FIG. 8) between the finger-touching preventing portion 31 and the ring portion 42 in the direction perpendicular to the axial direction of the female-side connecting body 21 is smaller than the size of the reference finger. The outer diameter of the finger-touching preventing portion 31 is determined such that the female connector 10 has such a gap S1, for example. If an increase in the outer diameter of the finger-touching preventing portion 31 is limited, the end of the finger-touching preventing portion 31 may, as illustrated in FIG. 11, further protrude so that the finger-touching preventing portion 31 and the ring portion 42 can prevent fingers from reaching the female terminal 20. In this case, the ring portion 42 also protrudes further beyond the end surface 21*b*. For example, the ring portion 42 further protrudes by the same amount as the end of the finger-touching preventing portion 31 protrudes.

The end of the finger-touching preventing portion 31 at the side of the connector insertion direction protrudes beyond the end surface 21*b* of the female-side connecting body 21. This configuration allows, when the male connector 110 is inserted and fitted in the female connector 10, the end of the finger-touching preventing portion 31 to be inserted in the first space 131*b* defined by the outer tube 131 of the male-side insulator 130 before the male terminal 120 is inserted and fitted in the female terminal 20. In this regard, the protruding finger-touching preventing portion 31 of the female connector 10 carries out the centering function in inserting and fitting the male connector 110 in the female connector 10. To carry out the centering function of the female connector 10, for example, the end of the finger-touching preventing portion 31 may protrude beyond the ring portion 42 in the axial direction so that the finger-touching preventing portion 31 is inserted in the outer tube 131 before other portions are inserted in corresponding portions. To carry out the centering function of the female connector 10, for example, the finger-touching preventing portion 31 may be inserted in the outer tube 131 substantially simultaneously with the insertion operation of a female-side fitting portion 41 and a male-side fitting portion 141, which will be described later.

The ring portion 42 in the present example is included in the female-side fitting portion 41, which will be described later, of the female housing 40.

The female housing 40 is made of an insulating material such as synthetic resin. The female housing 40 has the female-side fitting portion 41 (FIGS. 8 and 9) having a tubular shape covering the female terminal 20 from outside to accommodate the female terminal 20 therein. The female-side fitting portion 41 is coaxially inserted and fitted in the male-side fitting portion 141, which will be described later, of the male housing 140. The annular end of the female-side fitting portion 41 at the side of the connector insertion direction, or an end portion at the side of the connector insertion direction, is used as the ring portion 42. The end of the female-side fitting portion 41 protrudes in the axial direction beyond the end surface 21*b* of the female-side connecting body 21 at the side of the connector insertion direction.

Described next is the male connector 110.

The male connector 110 includes, in addition to the male terminal 120 and the male-side insulator 130, the male housing 140 (FIGS. 8 and 9) that houses the male terminal 120 and the male-side insulator 130.

The male terminal 120 is made of a conductive material such as metal. The male terminal 120 has the tubular male-side connecting body 121 (FIGS. 1 to 4 and 7 to 9) configured to be coaxially inserted and fitted in the female-side space 21*a* defined by the female-side connecting body 21. The male-side connecting body 121 defines the male-side space 121*a*. In the present example, the male-side connecting body 121 has a cylindrical shape.

The male-side insulator 130 is made of an insulating material such as synthetic resin. The male-side insulator 130 is provided to prevent fingers from touching the end of the male terminal 120 at the side of the connector insertion direction. The male-side insulator 130 prevents, together with the male housing 140, fingers from touching the male terminal 120. The male-side insulator 130 has the tubular outer tube 131 (FIGS. 1, 2, and 7 to 9) that covers coaxially an annular end surface 121*b* of the male-side connecting body 121 at the side of the connector insertion direction. In the present example, the outer tube 131 has a cylindrical shape.

The outer tube 131 is inserted in the female-side space 21*a* of the female-side connecting body 21 together with the male-side connecting body 121. The outer tube 131 has substantially the same outer diameter as, for example, that of the male-side connecting body 121 so as not to disturb the insertion operation. In a preferred embodiment, the outer tube 131 has an annular chamfered portion 131*a* (FIGS. 1, 2, and 7) circumferentially disposed at an end at the side of the connector insertion direction to facilitate insertion of the outer tube 131 in the female-side space 21*a*. The chamfered portion 131*a* may be a curved surface or a flat surface. The chamfered portion 131*a* in the present example has a tapered shape.

The finger-touching preventing portion 31 is inserted in the first space 131*b* (FIGS. 1, 2, and 7 to 9) defined by the outer tube 131. The first space 131*b* of the outer tube 131 is formed in such a shape that will not prevent a smooth insertion of the finger-touching preventing portion 31.

As described above, the finger-touching preventing portion 31 is also inserted in the male-side space 121*a* of the male-side connecting body 121. In a conventional fitting connector, the inner diameter of the male-side connecting body 121 is substantially the same as that of the outer tube 131, and this configuration may cause the finger-touching preventing portion 31 to be in contact with the male-side connecting body 121. The fitting connector 1 according to the present embodiment is configured not to allow the finger-touching preventing portion 31 to be in contact with the male-side connecting body 121. For ease of discussion, portions or members of the conventional fitting connector are referred to by the same reference signs as those of the fitting connector 1 according to the present embodiment.

In the present embodiment, an insulating tubular inner tube portion 132 (FIGS. 7 to 9) is inserted in the male-side space 121*a*, and is interposed between the finger-touching preventing portion 31 and the male-side connecting body 121 to prevent them from being in contact with each other. The inner tube portion 132 is coaxially inserted in the male-side space 121*a*. The finger-touching preventing portion 31 is inserted in the first space 131*b* of the outer tube 131 and then in a second space 132*a* (FIGS. 8 and 9) defined by the inner tube portion 132. In the present example, the inner tube portion 132 has a cylindrical shape.

In the fitting connector 1, the inner tube portion 132 is interposed between the finger-touching preventing portion 31 and the male-side connecting body 121. This configuration can prevent the finger-touching preventing portion 31 from being in contact with the male-side connecting body 121 during inserting or removing of the male terminal 120 in or from the female terminal 20, or while the female terminal 20 and the male terminal 120 are in the inserted and fitted state.

If, for example, the finger-touching preventing portion 31, which is relatively softer than the male-side connecting body 121, of the conventional fitting connector touches an edge of the inner circumferential surface of the male-side connecting body 121 close to the outer tube 131 during insertion of the finger-touching preventing portion 31 in the male-side space 121*a*, the edge may shave the finger-touching preventing portion 31. If the shavings, if any, of the finger-touching preventing portion 31 enter between the female terminal 20 and the male terminal 120 of the conventional fitting connector due to, for example, the vibration during use, this situation may cause failure in electrical connection therebetween. However, the fitting connector 1 according to the present embodiment can prevent creation of such shavings of the finger-touching preventing portion 31 and can increase the service life of the finger-touching preventing portion 31. In addition, the fitting connector 1 according to the present embodiment can prevent deterioration of electrical connection between the female terminal 20 and the male terminal 120 and thus can keep the connector performance of electrically connecting the male and female connectors.

The inner tube portion 132 having such a function may be prepared separately from the outer tube 131. However, to reduce the number of parts, which will lead to, for example, an easier assembling work and reduced manufacturing costs, the inner tube portion 132 is integrally formed with the outer tube 131 in one preferred embodiment. In other words, the inner tube portion 132 is provided as part of the male-side insulator 130 in a preferred embodiment. The inner tube portion 132 of the male-side insulator 130 according to the present embodiment coaxially protrudes from the outer tube 131.

For example, the male-side insulator 130 may be integrally molded (e.g., insert molding) with the male terminal 120 placed in a die. The male-side insulator 130 may be formed separately from the male terminal 120 and assembled with the male terminal 120 by inserting the inner tube portion 132 in the male-side space 121*a* of the male-side connecting body 121. To assemble the male-side insulator 130 with the male terminal 120, for example, the inner tube portion 132 is fitted in the male-side space 121*a*.

In one preferred embodiment, the axial length of the inner tube portion 132 is such that the end of the finger-touching preventing portion 31 at the side of the connector insertion direction is disposed in the second space 132*a* when the female-side connecting body 21 and the male-side connecting body 121 are in an inserted and fitted state. This configuration of the fitting connector 1 can substantially prevent the vibration of the end of the finger-touching preventing portion 31 if the inner tube portion 132 is a separate part from the male-side insulator 130 or if the inner tube portion 132 is part of the male-side insulator 130, and this can increase the contact prevention effect between the finger-touching preventing portion 31 and the male-side connecting body 121.

The male connector 110 includes an insulating ring portion 142 (FIGS. 8 and 9) disposed coaxially with the outer tube 131 and outwardly spaced apart from the outer tube 131 in a direction orthogonal to the axial direction of the outer tube 131. The male connector 110 includes the outer tube 131 and the ring portion 142 to prevent fingers from touching the male terminal 120. To prevent the fingers from touching the male terminal 120, the outer tube 131 and the ring portion 142 are spaced apart in the direction orthogonal to their axial direction by a gap S2 (FIG. 8) that is smaller than the size of a reference finger. The reference finger is, for example, the test finger specified in IPXXB degrees of protection as described above.

The ring portion 142 in the present example is included in the male-side fitting portion 141, which will be described later, of the male housing 140.

The male housing 140 is made of an insulating material such as synthetic resin. The male housing 140 has the male-side fitting portion 141 (FIGS. 8 and 9) having a tubular shape covering the male terminal 120 from outside to accommodate the male terminal 120 therein. The male connector 110 has a tubular space between the male terminal 120 and the male-side fitting portion 141. In this tubular space, the female-side connecting body 21 of the female terminal 20 and the female-side fitting portion 41 of the female housing 40 are coaxially inserted. The annular end of the male-side fitting portion 141 at the side of the connector insertion direction, or an end portion at the side of the connector insertion direction, is used as the ring portion 142. The end of the male-side fitting portion 141 protrudes in the axial direction beyond the end surface 121*b* of the male-side connecting body 121 at the side of the connector insertion direction.

As described above, the fitting connector 1 according to the present embodiment can prevent fingers from touching the female terminal 20 and the male terminal 120. For example, the female connector 10 according to the present embodiment can prevent fingers from touching the female terminal 20 with the ring portion 42 and the finger-touching preventing portion 31 protruding beyond the end surface 21*b* of the female-side connecting body 21 if the female connector 10 is of any size in the radial direction. Since the female connector 10 according to the present embodiment has the securing structure 60 between the accommodating portion 22 of the female terminal 20 and the accommodated portion 32 of the female-side insulator 30, the female terminal 20 and the female-side insulator 30 can be assembled and positioned relative to each other at an expected full accommodation position, if the female terminal 20 and the female-side insulator 30 are separately formed. This configuration allows the female connector 10 to carry out the finger-touching preventing function from the female connector 20.

The fitting connector 1 according to the present embodiment, which has a finger-touching preventing function of preventing fingers from touching the female terminal 20 or the male terminal 120, also has a contact preventing function. This function is carried out by the inner tube portion 132 that prevents the finger-touching preventing portion 31 from being in contact with the male-side connecting body 121. This function can substantially prevent deterioration of the electric connection between the female terminal 20 and the male terminal 120.

The female connector 10 according to the present embodiment, which has the finger-touching preventing function from the female terminal 20, can also have a centering function. This function is carried out by the finger-touching preventing portion 31 in inserting and fitting of the male connector 110 in the female connector 10. In other words, the finger-touching preventing portion 31 in the female connector 10 can carry out the finger-touching preventing function from the female terminal 20 and also carry out the centering function in fitting the connectors. This centering function is more effective when the end of the finger-touching preventing portion 31 protrudes beyond the end surface 21*b* of the female-side connecting body 21. The centering function is more effective with the effect of the securing function of the securing structure 60. Since the fitting connector 1 according to the present embodiment includes the female connector 10 described above, the fitting connector 1 can have the same effects as those of the female connector 10.

If the female terminal 20 and the female-side insulator 30 of the female connector 10 according to the present embodiment are separately formed, providing the securing structure 60 between the accommodating portion 22 of the female terminal 20 and the accommodated portion 32 of the female-side insulator 30 can facilitate the assembling process of the female terminal 20 and the female-side insulator 30. Since the fitting connector 1 according to the present embodiment includes the female connector 10 described above, the fitting connector 1 can have the same effects as those of the female connector 10.

The female connector according to the present embodiment includes a securing structure between the accommodating portion of the female terminal and the accommodated portion of the female-side insulator, and this configuration allows the separately formed female terminal and female-side insulator to be assembled and positioned relative to each other at an expected full accommodation position. Since the fitting connector according to the present invention includes this female connector, the fitting connector can have the same effect as that of the female connector.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A female connector comprising:

a female terminal configured to be physically and electrically connected to a male terminal of a male connector including the male terminal and an insulating male-side insulator, the male terminal having a tubular male-side connecting body, the male-side insulator having a tubular outer tube covering coaxially an end surface of the male-side connecting body at a side of a connector insertion direction; and an insulating female-side insulator, wherein the female terminal has a tubular female-side connecting body defining a female-side space in which the male-side connecting body is coaxially inserted and fitted, and has a tubular accommodating portion defining an accommodation space in which the female-side insulator is accommodated and retained, the female-side connecting body and the accommodating portion being coaxially aligned, the female-side insulator has a columnar or tubular finger-touching preventing portion and a columnar or tubular accommodated portion, the finger-touching preventing portion being coaxially disposed in the female-side space, and disposed in a space defined by the outer tube and in a male-side space defined by the male-side connecting body when the female-side connecting body and the male-side connecting body are in an inserted and fitted state, the accommodated portion being coaxially accommodated in the accommodation space, a securing structure that secures the accommodating portion and the accommodated portion relative to each other at a full accommodation position is provided between the accommodating portion and the accommodated portion, the securing structure includes a first securing portion provided in the accommodating portion and a second securing portion provided in the accommodated portion, the first securing portion and the second securing portion being engaged with each other to secure the accommodating portion and the accommodated portion relative to each other at the full accommodation position, the second securing portion is formed as a securing protrusion that protrudes from the accommodating portion or the accommodated portion in a direction orthogonal to an axial direction of the accommodating portion and the accommodated portion, the first securing portion is formed as a locking part having a through-hole or an indentation shape, the locking part in which the securing protrusion is inserted and locked in the axial direction and a circumferential direction of the accommodating portion and the accommodated portion, the accommodated portion has a retraction space and a flexible tip having flexibility, the flexible tip has a fixed end and a free end, the securing protrusion is provided at a free end, and the securing protrusion is retracted in to the retraction space with bending of the flexible tip while being pushed by the inner circumferential surface of the accommodation space, and the flexible tip is moved to the retraction space, and the first securing portion is engaged with the second securing portion by being inserted into the locking part together with release of the bend state of the flexible tip.

2. The female connector according to claim 1, wherein the accommodating portion has an opening away from the female-side connecting body, the opening being used as an insertion opening for the female-side insulator, and the female connector further includes a guiding structure between the accommodating portion and the accommodated portion to guide the accommodated portion that is axially inserted from the insertion opening to the full accommodation position is provided.

3. A fitting connector comprising:

a female connector including a female terminal and an insulating female-side insulator; and a male connector including a male terminal and an insulating male-side insulator, wherein the female terminal has a tubular female-side connecting body defining a female-side space, and has a tubular accommodating portion defining an accommodation space in which the female-side insulator is accommodated and retained, the female-side connecting body and the accommodating portion being coaxially aligned, the male terminal has a tubular male-side connecting body configured to be coaxially inserted and fitted in the female-side space, the male-side insulator has a tubular outer tube covering coaxially an end surface of the male-side connecting body at a side of a connector insertion direction, the female-side insulator has a columnar or tubular finger-touching preventing portion and a columnar or tubular accommodated portion, the finger-touching preventing portion being coaxially disposed in the female-side space, and disposed in a space defined by the outer tube and in a male-side space defined by the male-side connecting body when the female-side connecting body and the male-side connecting body are in an inserted and fitted state, the accommodated portion being coaxially accommodated in the accommodation space, a securing structure that secures the accommodating portion and the accommodated portion relative to each other at a full accommodation position is provided between the accommodating portion and the accommodated portion, the securing structure includes a first securing portion provided in the accommodating portion and a second securing portion provided in the accommodated portion, the first securing portion and the second securing portion being engaged with each other to secure the accommodating portion and the accommodated portion relative to each other at the full accommodation position, the second securing portion is formed as a securing protrusion that protrudes from the accommodating portion or the accommodated portion in a direction orthogonal to an axial direction of the accommodating portion and the accommodated portion, the first securing portion is formed as a locking part having a through-hole or an indentation shape, the locking part in which the securing protrusion is inserted and locked in the axial direction and a circumferential direction of the accommodating portion and the accommodated portion, the accommodated portion has a retraction space and a flexible tip having flexibility, the flexible tip has a fixed end and a free end, the securing protrusion is provided at the free end, and the securing protrusion is retracted in to the retraction space with bending of the flexible tip while being pushed by the inner circumferential surface of the accommodation space, and the flexible tip is moved to the retraction space, and the first securing portion is engaged with the second securing portion by being inserted into the locking part together with release of the bend state of the flexible tip.

* * * * *